US009493959B2

(12) United States Patent
Gutierrez et al.

(10) Patent No.: US 9,493,959 B2
(45) **Date of Patent: *Nov. 15, 2016**

(54) APPARATUS FOR FORMING TEMPORARY GUARDRAIL ON STAIRS

(75) Inventors: Miguel Osvaldo Gutierrez, Atlanta, GA (US); Andrew H. Hilliard, Houston, TX (US)

(73) Assignee: Safety Maker, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/413,379

(22) Filed: Mar. 6, 2012

(65) Prior Publication Data

US 2012/0205604 A1 Aug. 16, 2012

Related U.S. Application Data

(63) Continuation-in-part of application No. 12/775,817, filed on May 7, 2010, now abandoned.

(51) Int. Cl.
*E04G 21/32* (2006.01)
*E04F 11/18* (2006.01)

(52) U.S. Cl.
CPC ..... *E04G 21/3204* (2013.01); *E04F 11/1865* (2013.01)

(58) Field of Classification Search
CPC ..... E04G 21/3204; E04F 11/1865
USPC ..... 403/59, 68, 69, 65.15, DIG. 2, DIG. 4, 403/DIG. 6; 182/113
See application file for complete search history.

(56) References Cited

U.S. PATENT DOCUMENTS

| | | | | | |
|---|---|---|---|---|---|
| 2,329,415 | A | * | 9/1943 | Osborne | 248/237 |
| 2,332,477 | A | * | 10/1943 | Thornley | 182/87 |
| 2,429,949 | A | * | 10/1947 | Thayer | 52/600 |
| 3,018,077 | A | * | 1/1962 | Buehler | 248/539 |
| 3,584,839 | A | * | 6/1971 | Dickey | 256/59 |
| 3,747,898 | A | * | 7/1973 | Warren | 256/59 |
| 3,825,098 | A | * | 7/1974 | Shingler | 182/106 |
| 3,863,900 | A | * | 2/1975 | Dagiel et al. | 256/59 |
| 3,901,481 | A | * | 8/1975 | Probst | 256/59 |
| 4,635,891 | A | * | 1/1987 | McDonough | 248/542 |
| 4,979,725 | A | * | 12/1990 | Hutchings et al. | 256/64 |
| 5,314,167 | A | | 5/1994 | Holloman | |
| 5,456,451 | A | * | 10/1995 | Eyler, Jr. | 256/67 |
| 5,931,449 | A | * | 8/1999 | Gwaltney | 256/24 |
| 6,015,139 | A | * | 1/2000 | Weber | 256/65.14 |
| 6,481,697 | B1 | * | 11/2002 | Brown | 256/64 |
| 6,679,482 | B2 | * | 1/2004 | Allenbaugh | 256/65.14 |

(Continued)

FOREIGN PATENT DOCUMENTS

| | | |
|---|---|---|
| CH | 590385 | 8/1977 |
| TW | 200839072 | 10/2008 |

*Primary Examiner* — Jonathan Masinick
(74) *Attorney, Agent, or Firm* — BushmanWerner, P.C.

(57) ABSTRACT

An apparatus for use in erecting a temporary guardrail on a stair, having a stair stringer. The apparatus has an elongated stanchion. A first jaw assembly is operatively attached to the stanchion for engaging one side of the stringer, proximal the bottom edge thereof, and includes a first compression assembly to operatively urge the stanchion against the stringer. A second axially spaced, jaw assembly is operatively attached to the stanchion for engaging the one side of the stringer proximal a top edge thereof, and includes a second compression assembly to urge the stanchion against the stringer, and a bracket attached to the stanchion, and being adapted to receive a temporary guardrail member.

18 Claims, 4 Drawing Sheets

(56) References Cited

U.S. PATENT DOCUMENTS 6,905,110 B2 * 6/2005 Brown ..... 256/67
7,048,090 B2 * 5/2006 Dean et al. ..... 182/3
7,272,204 B2 * 9/2007 Jensen ..... 376/260
2003/0122117 A1 7/2003 Brown
2007/0246299 A1 * 10/2007 Wright et al. ..... 182/113

* cited by examiner

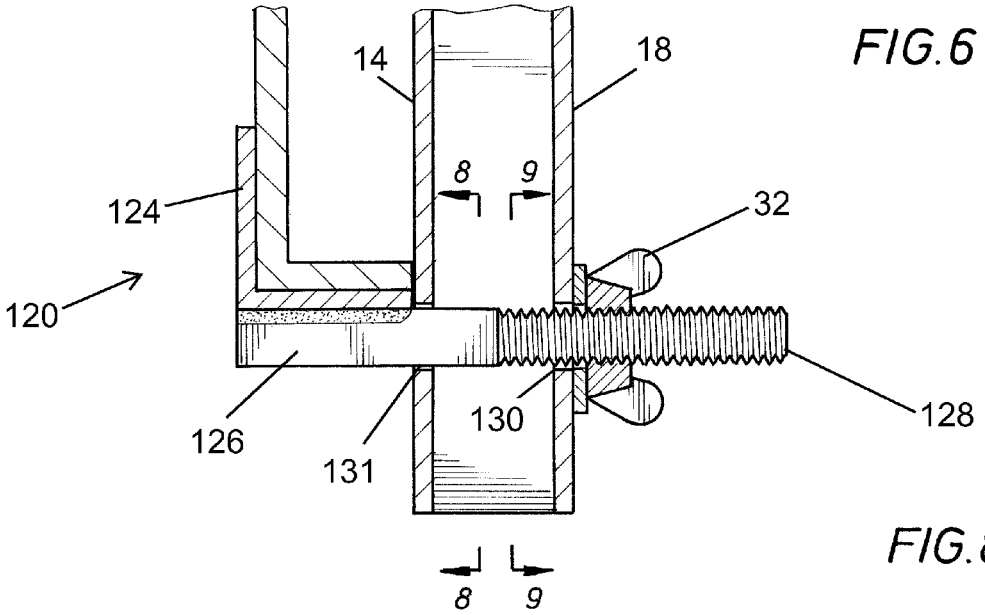
FIG.6
FIG.8
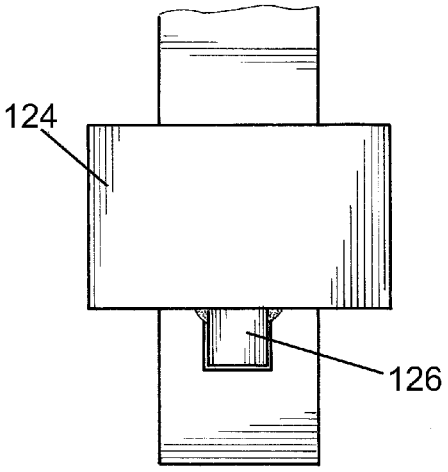
FIG.7
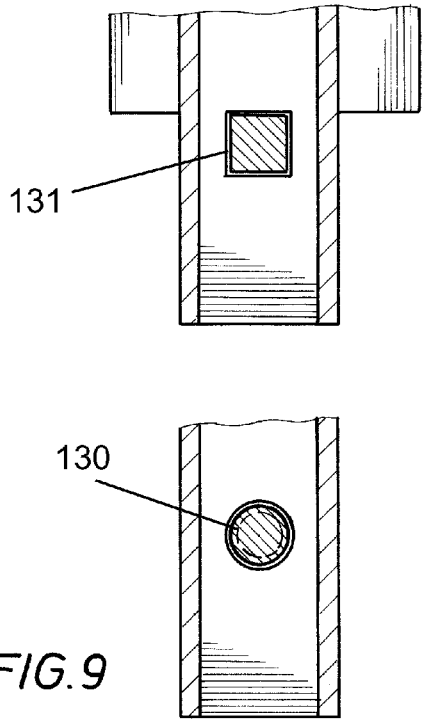
FIG.9

APPARATUS FOR FORMING TEMPORARY GUARDRAIL ON STAIRS

CROSS REFERENCE TO RELATED APPLICATION

This application is a continuation-in-part of U.S. application Ser. No. 12/775,817 filed on May 7, 2010 now abandoned the disclosure of which is incorporated herein by reference for all purposes.

FIELD OF THE INVENTION

The present invention relates to temporary guardrails and, more particularly, to an apparatus for erecting a temporary guardrail on a stair.

BACKGROUND OF THE INVENTION

Typically, stairs, particularly of the type in apartment buildings and the like, comprise three major components: stringers, treads and risers, although in certain stair constructions; e.g., pan stairs, there are no risers, open space is being formed between the treads. The stringers can be made of a steel channel beam, wood, etc., the dimensions of which can vary depending upon the load to be carried. As is well known, the treads are the generally horizontal portions of the stair, while the risers are the vertical portions connecting the treads.

Because of safety concerns during construction or remodeling, it is generally necessary, before a permanent handrail or guardrail is installed, to erect a temporary guardrail or handrail, and thereby minimize the chance of injuries from a construction worker falling off the stair.

SUMMARY OF THE INVENTION

One object of the present invention is to provide an assembly for erecting a temporary guardrail on a stair.

Another object of the present invention is to provide an apparatus for erecting a temporary guardrail on a stair, which can be quickly assembled and disassembled, as needed.

In one aspect, the present invention comprises a stanchion or other elongate member, first and second, spaced jaws connected to the stanchion, which are adapted to rigidly connect the stanchion to the stringer in such a manner that the stringer is substantially perpendicular to the pitch of the stair. The apparatus of the present invention can further comprise, at least one bracket which can receive a temporary handrail; e.g., a 2×4 or the like.

BRIEF DESCRIPTION OF THE DRAWINGS

FIG. 6 is a cross-sectional, view of another embodiment of the jaw assembly portion of FIG. 4.

FIG. 7 is an elevational view of the front side of the embodiment shown in FIG. 6.

FIG. 8 is a cross-sectional view taken along the lines 8-8 of FIG. 6.

FIG. 9 is a cross-sectional view taken along the lines 9-9 of FIG. 6.

DESCRIPTION OF PREFERRED EMBODIMENTS

Figure 1:
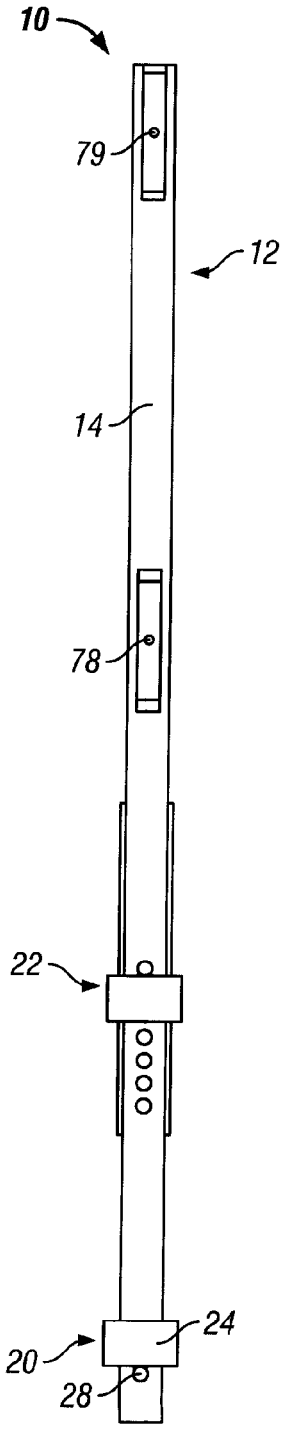
FIG. 1 is an elevational view of the front side of one embodiment of the apparatus of the present invention.
Figure 2:
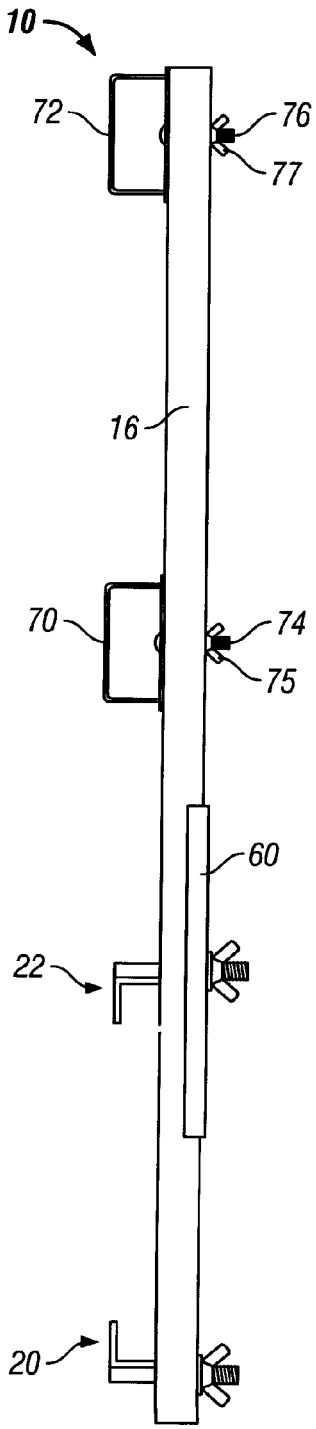
FIG. 2 is an elevational, side view of the apparatus shown in FIG. 1.
Figure 3:
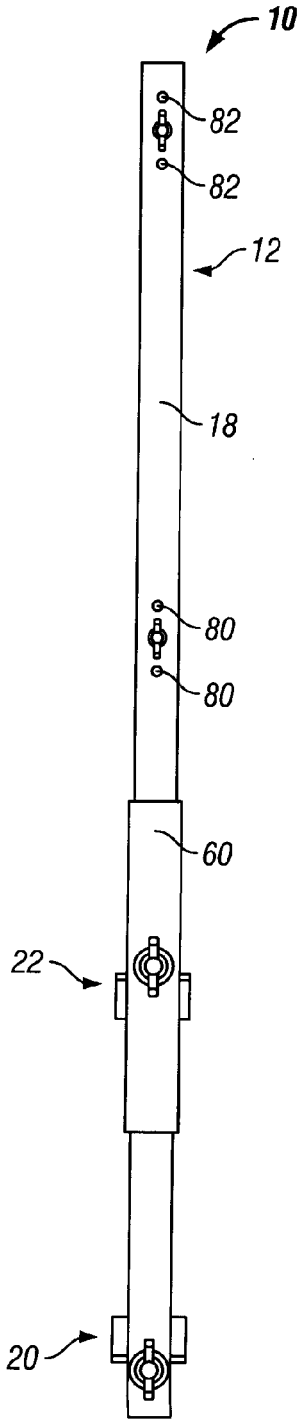
FIG. 3 is an elevational view of the back side of the apparatus of FIGS. 1 and 2.

Referring first to FIGS. 1-3, the apparatus of the present invention, shown generally as 10, comprises a metal tubular member or stanchion 12, having a front side 14, a first side 16, a second, opposite side (not shown), and a back side 18 (FIG. 3). Located generally near the lower end of the stanchion 12 is a first jaw assembly shown generally as 20, a second jaw assembly shown generally as 22 being spaced longitudinally from first jaw assembly 20 in a direction toward the upper end of stanchion 12.

Figure 5:
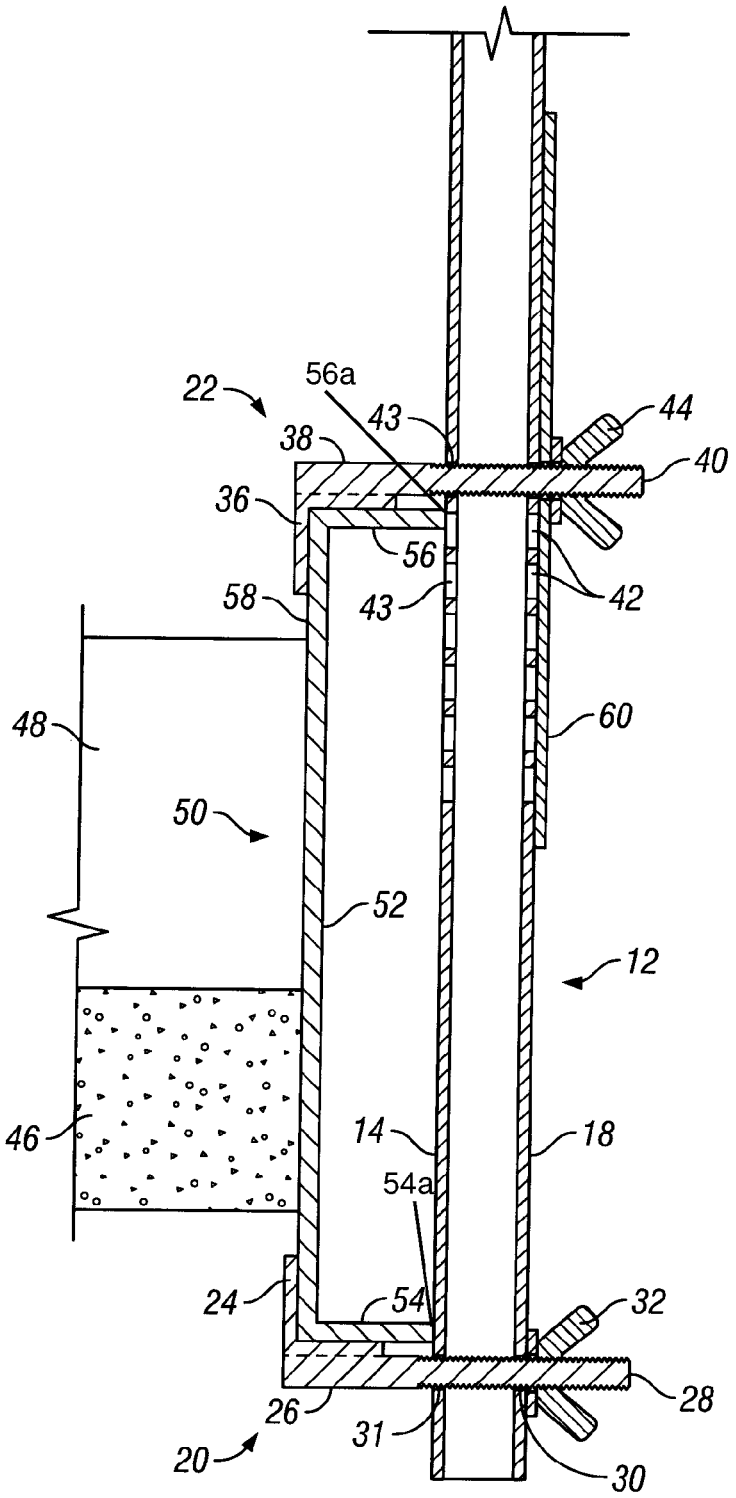
FIG. 5 is a cross-sectional view taken along the lines 5-5 of FIG. 4.

With reference to FIG. 5, the details of construction of jaw assemblies 20 and 22 are shown. Bottom jaw assembly 20 comprises an L-shaped head portion having a flange portion 24 and a leg portion 26 attached thereto, a threaded shank 28 extending from leg portion 26 and through registering bores 31 and 30 in the front and back sides 14 and 18, respectively. A wing nut 32 is threadedly received on the portion of shank portion 28 extending out of bore 30, a washer 34 being positioned between wing nut 32 and back surface 18. In effect, threaded shank 28 and wing nut 32 comprise a compression assembly for a purpose described hereafter. Second jaw assembly 22 also comprises an L-shaped head portion having a flange portion 36, a leg portion 38, a threaded shank portion 40 extending from leg portion 38 through registering bores 42 and 43 in stanchion 12. A wing nut 44 is threadedly received on the portion of threaded shank 40 extending through back side 18 of stanchion 12. As can be seen, stanchion 12 has a plurality of registering bores 42 and 43, through which threaded shank 40 can extend to allow jaw assembly 22 to be adjustable longitudinally along stanchion 12. To provide strength, a channel shaped spacer 60, effectively a washer, can be used, the spacer 60 overlying the plurality of bores on the back side 18 of stanchion 12.

Figure 4:
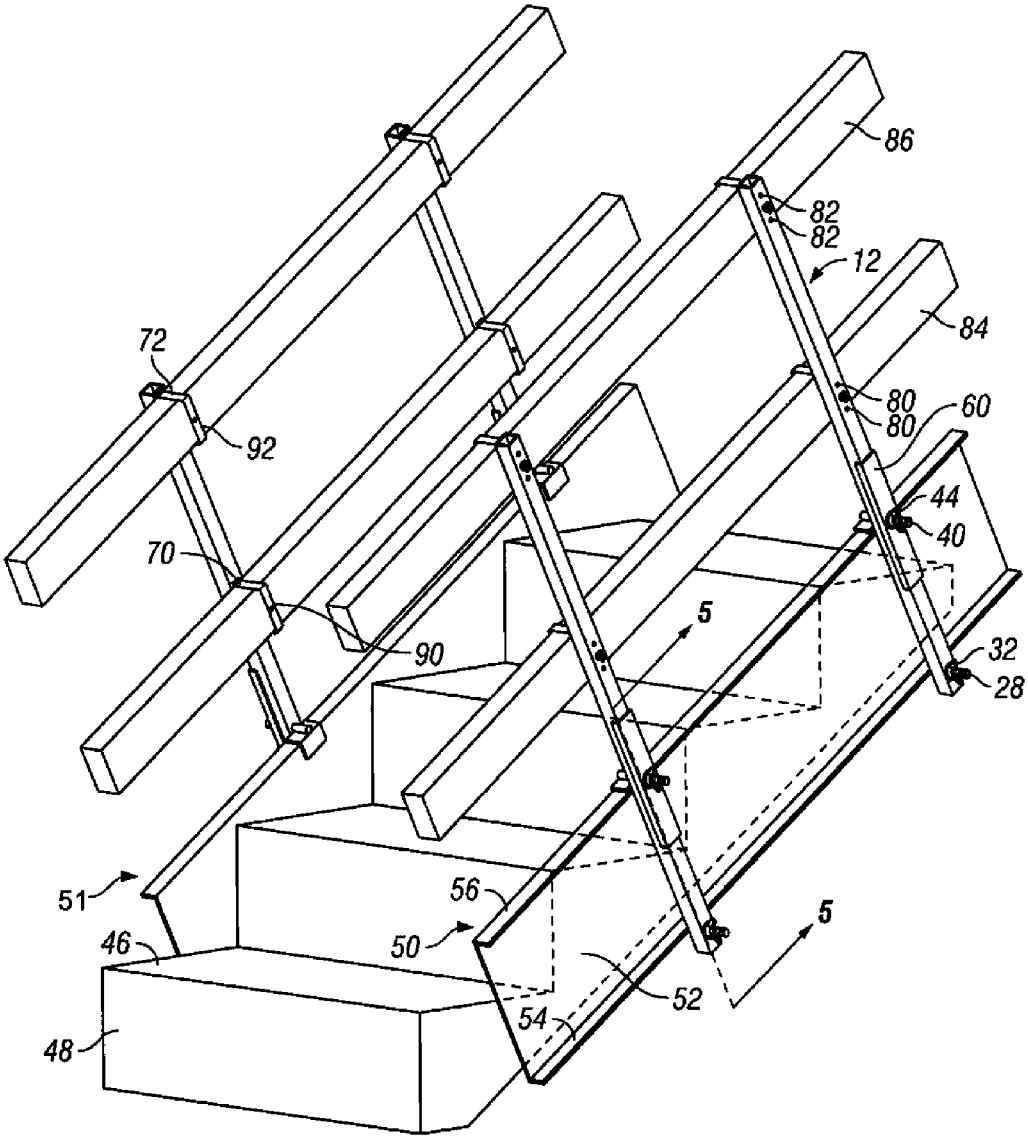
FIG. 4 is an isometric, environmental view of a temporary guardrail attached to a stair stringer, using one embodiment of the apparatus of the present invention.

As can be seen, FIG. 5 is a cross-sectional view taken along the lines 5-5 of FIG. 4 and accordingly, shows a portion of a stair assembly. The stair assembly comprises treads 46 and risers 48, which are attached in a suitable fashion to stringers 50, 51 which support the stair. For purposes of the following description, the detailed construction of only one of the stringers of the apparatus of the present invention will be described. Further, although a stair with two stringers is shown, it will be apparent that many stairs are constructed against a wall so that only one stringer would have a guardrail. Furthermore, although the stairs shown have risers, as noted above, in the case of pan stairs there are no risers. As can be seen in FIG. 4, the stringers 50, 52 act as side supports for the stair and are generally at the desired pitch of the stairs. Stringer 50 comprises a channel shaped metal beam, having a main beam portion 52 and spaced, laterally extending flanges 54 and 56. As can be seen in FIG. 5, flanges 54 and 56 space beam portion 52 from stanchion 12. It will be appreciated that the stringer 50 need not be channel-shaped but could be a square tubular member, a wooden beam, etc., but in any event, would have a surface 58 spaced from stanchion 12.

As can be seen in FIG. 5, stringer 50 is received between first and second jaw assemblies 20 and 22, such that flange portion 24 abuts the side 58 of stringer beam portion 52 adjacent flange portion 54 and that flange portion 36 abuts the side 58 of stringer beam portion 52 adjacent flange portion 56. Further, when so positioned, it can be seen that by tightening wing nuts 32 and 44, flanges 24 and 36, respectively, will urge stanchion 12 toward stringer 50, stanchion 12 being compressed against the outer edges 54*a* and 56*a* of flanges 54 and 56 of stringer 50, thereby rigidly securing stanchion 12 to stringer 50, the outer surface of flange 54 forming a bottom edge of stringer 50, the outer surface of flange 56 forming a top edge.

With reference to FIGS. 1-4, it can be seen that the apparatus of the present invention is provided with first and second brackets or tubular members 70 and 72, which are affixed to stanchion 12 by means of bolts 74 and 76, respectively, which extend through registering bores 80, 82 in the front side 14 and back side 18 of stanchion 12. Although brackets 70 and 72 are shown as tubular, they could be L-shaped in construction or for that matter, any other form, the only proviso being that they be adapted to support a temporary guardrail; e.g., a 2×4. As shown, 2×4 temporary rails 84 and 86 are received in brackets 70 and 72, respectively, the rails being secured to the brackets 70 and 72 by fasteners 90 and 92; e.g., a screw, nail or the like, extending through holes 78, 79 of brackets 70, 72, respectively. Threaded wing nuts 75 and 77 are received on bolts 74 and 76, respectively, to secure brackets 70 and 72, respectively, to stanchion 12. It will be appreciated from the above description that jaws 20, 22 and brackets 70 and 72 are rotatable with respect to stanchion 12, such that they can be disposed at any desired angle, if necessary, to accommodate and provide rails which are at any desired angle. However, typically the guardrails are at an angle the same as the angle of the pitch line of the stair, as shown in FIG. 4.

As is the case with jaw assembly 22, it can be seen that brackets 70 and 72 can be longitudinally adjusted along stanchion 12 by virtue of a plurality of registering bores, such as 80 and 82.

Referring now to FIGS. 6-9, there is seen another embodiment of the jaw assembly, shown generally as 120. Jaw assembly 120 comprises an L-shaped head portion having a flange portion 124, a leg portion 126 attached thereto, and a threaded shank 128 extending from leg portion 126. Registering bores 131 and 130 are in the front and back sides 14 and 18, respectively of the stanchion 12. Leg portion 126 extends through bore 131 and shank portion 128 extends through bore 130. Wing nut 32 is threadedly received on the portion of shank 128 extending out of bore 130, to form a compression assembly.

Leg portion 126 and bore 131 have cross-sectional shapes such that rotation of the leg portion is prevented relative to the bore. As shown in FIGS. 6-9, leg portion 126 and bore 131 both have rectangular cross-sections, however, it will be understood that any cross-sectional shapes which prevent relative rotation to one another are within the scope of the invention. Leg portion 126 and bore 131 can be keyed together and complementary or not. Leg portion 126 and bore 131 may have different cross-sectional shapes so long as their respective cross-sections prevent relative rotation when leg portion 126 is extended through bore 131. Leg portion 126 need not have a uniform cross-section. It is contemplated that at least a portion of leg portion 126 will extend through bore 131. In some embodiments though, leg portion 126 may have a uniform cross-section, thus allowing the entire leg portion to extend through bore 131.

FIG. 6 illustrates a bottom jaw assembly, but it will be understood that the embodiment of FIG. 6 could be used in place of any of the jaw assemblies described herein.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

What is claimed is:

1. A mounting apparatus for use in erecting a temporary guardrail on a stair stringer having a stringer web forming a first engagement surface, a bottom stringer flange and a top stringer flange, said bottom stringer flange and said top stringer flange forming second and third spaced engagement surfaces, respectively, said mounting apparatus comprising:

an elongated stanchion having a front side and a back side;

a first front bore in said front side of said stanchion and a first back bore in said back side of said stanchion, said first front and back bores forming a first registering pair of bores;

a first jaw assembly releasably attached to said stanchion, said first jaw assembly including a first head portion having a first flange portion adapted to engage said first engagement surface of said stair stringer proximal said bottom stringer flange thereof and a first leg portion attached to said first flange portion, said first leg portion extending through said first registering pair of bores and connected to a first compression assembly and operative to apply a compressive force to the back side of said stanchion to urge said stanchion against the second engagement surface of said stringer;

a second front bore in said front side of said stanchion and a second back bore in said back side of said stanchion, said second front and back bores forming a second registering pair of bores, said second registering pair of bores being axially spaced from said first registering pair of bores;

a second, spaced jaw assembly releasably attached to said stanchion, said second jaw including a second head portion having a second flange portion, adapted to engage said first engagement surface of said stringer proximal said top stringer flange thereof and a second leg portion attached to said second flange portion, said second leg portion extending through said second registering pair of bores and connected to a second compression assembly and operative to apply a compressive force to the back side of said stanchion to urge said stanchion against the third engagement surface of said stringer wherein when said mounting apparatus is attached to said stringer, said first leg portion is below said bottom stringer flange of said stringer and said second leg portion is above said top stringer flange of said stringer, and whereby no portion of said mounting apparatus is within the area between said top stringer flange and said bottom stringer flange and no holes are formed in said stringer web to connect said mounting apparatus;

a third front bore in said front side of said stanchion and a third back bore in said back side of said stanchion, said third front and back bores forming a third registering pair of bores, said third registering pair of bores being axially spaced from said first and second registering pairs of bores, said first or second leg portions being movable from said first or second registering pair of bores to extend through said third registering pair of bores; and at least one bracket operatively attached to said stanchion and axially spaced from said second jaw, said bracket being adapted to receive a temporary rail member.

2. The apparatus of claim 1, wherein said first head portion is L-shaped, said first leg portion includes a first shank portion extending from said first leg portion and a first tightener operatively connected to said first shank portion to urge said first shank portion in a direction away from said first flange portion to thereby compressively urge said first flange portion into engagement with said first engagement surface of said stringer.

3. The apparatus of claim 2, wherein said first shank portion spans said front and back sides of said stanchion.

4. The apparatus of claim 3, wherein said first shank portion extends through said first registering pair of bores.

5. The apparatus of claim 2, further comprising:

said first front bore in said front side having a first cross-sectional shape, the portion of said first leg portion proximal said first shank portion having a second cross-sectional shape, said portion of said first leg portion extending through said first front bore in said front side, said first and second cross-sectional shapes preventing rotation of said portion of said first leg portion relative to said first front bore in said front side, and said first shank portion extending through said first back bore in said back side.

6. The apparatus of claim 5, wherein the cross-sectional shape of said first leg portion is uniform.

7. The apparatus of claim 1, wherein said second head portion is L-shaped, said second leg portion includes a second shank portion extending from said second leg portion and a second tightener operatively connected to said second shank portion to urge said second shank portion in a direction away from said second flange portion to thereby compressively urge said second flange portion into engagement with the first engagement surface of said stringer.

8. The apparatus of claim 7, wherein said second shank portion spans said front and back sides of said stanchion.

9. The apparatus of claim 8, wherein said second shank portion extends through said second registering pair of bores.

10. The apparatus of claim 9, wherein said second shank portion is movable to extend through said third registering pair of bores.

11. The apparatus of claim 10, wherein there is a spacer overlying any of said second or third front bores on said front side of said stanchion, said spacer being disposed between said second tightener and said front side of said stanchion.

12. The apparatus of any one of claims 4 and 7, wherein said shank portion is threaded and said tighteners comprise a nut.

13. The apparatus of claim 7, further comprising:

said second front bore in said front side having a first cross-sectional shape, the portion of said second leg portion proximal said second shank portion having a second cross-sectional shape, said portion of said second leg portion extending through said second front bore in said front side, said first and second cross-sectional shapes preventing rotation of said portion of said second leg portion relative to said second front bore in said front side, and said second shank portion extending through said second back bore in said in said back side.

14. The apparatus of claim 13, wherein the cross-sectional shape of said second leg portion is uniform.

15. The apparatus of claim 1, wherein there are at least two of said brackets axially spaced from said second jaw assembly.

16. The apparatus of claim 1, wherein said first jaw assembly, said second jaw assembly, and said at least one bracket, are rotatable relative to said stanchion.

17. A temporary guardrail system for a stair having a stair stringer having a stringer web forming a first engagement surface, a bottom stringer flange and a top stringer flange, said bottom stringer flange and said top stringer flange forming second and third spaced engagement surfaces, respectively, said mounting apparatus comprising:

an elongated stanchion having a front side and a back side;

a first front bore in said front side of said stanchion and a first back bore in said back side of said stanchion, said first front and back bores forming a first registering pair of bores;

a first jaw assembly releasably attached to said stanchion, said first jaw assembly including a first head portion having a first flange portion adapted to engage said first engagement surface of said stair stringer proximal said bottom stringer flange thereof and a first leg portion attached to said first flange portion, said first leg portion extending through said first registering pair of bores and connected to a first compression assembly operative to apply a compressive force to the back side of said stanchion to urge said stanchion against the second engagement surface of said stringer;

a second front bore in said front side of said stanchion and a second back bore in said back side of said stanchion, said second front and back bores forming a second registering pair of bores, said second registering pair of bores being axially spaced from said first registering pair of bores;

a second, spaced jaw assembly releasably attached to said stanchion, said second jaw including a second head portion having a second flange portion, adapted to engage said first engagement surface of said stringer proximal said top stringer flange thereof and a second leg portion attached to said second flange portion, said second leg portion extending through said second registering pair of bores and connected to a second compression assembly operative to apply a compressive force to the back side of said stanchion to urge said stanchion against the third engagement surface of said stringer wherein when said temporary guardrail system is attached to said stringer, said first leg portion is below said bottom stringer flange of said stringer and said second leg portion is above said top stringer flange of said stringer, and whereby no portion of said mounting apparatus is within the area between said top stringer flange and said bottom stringer flange and no holes are formed in said stringer web to connect said mounting apparatus;

a third front bore in said front side of said stanchion and a third back bore in said back side of said stanchion, said third front and back bores forming a third registering pair of bores, said third registering pair of bores being axially spaced from said first and second registering pairs of bores, said first or second leg portions being movable from said first or second registering pair of bores to extend through said third registering pair of bores;

at least one bracket operatively attached to said stanchion and axially spaced from said second jaw, said bracket being adapted to receive a temporary rail member; and a rail member received in said bracket.

18. The apparatus of claim 17, wherein said rail member comprises a 2×4.

* * * * *